US008776863B2

(12) United States Patent
Fukuda

(10) Patent No.: US 8,776,863 B2
(45) Date of Patent: Jul. 15, 2014

(54) MOLTEN METAL POURING NOZZLE AND CONTINUOUS MOLDING DEVICE

(75) Inventor: Masashi Fukuda, Kitakata (JP)

(73) Assignee: Showa Denko K.K., Tokyo (JP)

( * ) Notice: Subject to any disclaimer, the term of this patent is extended or adjusted under 35 U.S.C. 154(b) by 31 days.

(21) Appl. No.: 12/808,724

(22) PCT Filed: Dec. 17, 2008

(86) PCT No.: PCT/JP2008/072968

§ 371 (c)(1),
(2), (4) Date: Jan. 11, 2011

(87) PCT Pub. No.: WO2009/078433

PCT Pub. Date: Jun. 25, 2009

(65) Prior Publication Data

US 2011/0120665 A1 May 26, 2011

(30) Foreign Application Priority Data

Dec. 18, 2007 (JP) ..... 2007-326371

(51) Int. Cl.
*B22D 11/10* (2006.01)
*B22D 35/00* (2006.01)

(52) U.S. Cl.
USPC ..... 164/437; 164/440; 222/606

(58) Field of Classification Search
USPC ..... 164/437, 440, 490, 472; 222/566, 606
See application file for complete search history.

(56) References Cited

U.S. PATENT DOCUMENTS

| | | | | |
|---|---|---|---|---|
| 3,076,241 | A * | 2/1963 | Reamey, Jr. et al. | 164/472 |
| 3,363,669 | A * | 1/1968 | Wertli | 164/440 |
| 3,395,840 | A * | 8/1968 | Gardner | 222/591 |
| 5,360,147 | A * | 11/1994 | Aoki et al. | 222/600 |
| 6,125,917 | A * | 10/2000 | Cassar et al. | 164/428 |
| 6,637,629 | B2 * | 10/2003 | Ohtsuka et al. | 222/606 |
| 2006/0054906 | A1 * | 3/2006 | Inoue et al. | 257/89 |
| 2006/0090875 | A1 | 5/2006 | Fukuda et al. | |
| 2006/0118269 | A1 | 6/2006 | Odashima et al. | |
| 2009/0020567 | A1 | 1/2009 | Numano et al. | |

FOREIGN PATENT DOCUMENTS

| | | |
|---|---|---|
| DE | 2 165 537 A1 | 7/1973 |
| DE | 26 04 478 A1 | 8/1977 |
| JP | 62-46164 U | 3/1987 |

(Continued)

OTHER PUBLICATIONS

BNZ Materials Inc. MSDS Sheet for Marinite. http://www.bnzmaterials.com/msds/msdsma1.html.*

(Continued)

*Primary Examiner* — Kevin P Kerns
*Assistant Examiner* — Steven Ha
(74) *Attorney, Agent, or Firm* — Keating & Bennett, LLP

(57) ABSTRACT

A molten metal pouring nozzle capable of preventing reaction with a molten metal and casting a high quality ingot continuously for a long period of time is provided. A molten metal pouring nozzle 20 arranged between a molten metal receiving portion 10 and a mold 40 of a continuous casting device 1 is equipped with a main body portion 22 having at least one molten metal passage 21 and made of a fire-resistant substance, and a sleeve 23 made of a material which does not react with the molten metal and having a heat conductivity of 10 to 30 W/(m·° C.) is fitted in the molten metal passage 21 of the main body portion 22.

12 Claims, 7 Drawing Sheets

(56) References Cited

FOREIGN PATENT DOCUMENTS

| | | | |
|---|---|---|---|
| JP | 64-057960 | A | 3/1989 |
| JP | 11-170014 | A | 6/1999 |
| JP | 2000-094098 | A | 4/2000 |
| JP | 2004-066345 | A | 3/2004 |
| JP | 2006-110558 | A | 4/2006 |
| JP | 2006-150448 | A | 6/2006 |
| JP | 2006-263784 | A | 10/2006 |
| SU | 997963 | A1 | 2/1983 |

OTHER PUBLICATIONS

English Machine Translation of JP-2000-094098.*

Official Communication issued in International Patent Application No. PCT/JP2008/072968, mailed on Mar. 31, 2009.

Official Communication issued in corresponding European Patent Application No. 08861357.5, mailed on Oct. 27, 2011.

Informationszentrum Technische Keramik: "Thermische Eigenschaften Technischer Keramik", Sep. 28, 2004.

Official Communication issued in corresponding Japanese Patent Application No. 2007-326371, mailed on Mar. 12, 2013.

* cited by examiner

MOLTEN METAL POURING NOZZLE AND CONTINUOUS MOLDING DEVICE

TECHNICAL FIELD

The present invention relates to a molten metal pouring nozzle to be arranged between a molten metal receiving portion and a mold, and a continuous casting device equipped with the molten metal pouring nozzle.

BACKGROUND ART

FIG. 6 shows a structure of a conventional horizontal continuous casting device 2 (see Patent Documents 1 and 2).

In the aforementioned horizontal continuous casting device 2, the molten metal M in the molten metal receiving portion 10 passes through a molten metal passage 71 of a molten metal pouring nozzle 70 via a molten metal outlet port 11. Thereafter, the molten metal M is introduced into a mold 40 arranged approximately horizontally, and forcibly cooled to thereby form a solidified shell on an outer surface of the molten metal. Furthermore, cooling water C is directly sprayed onto the ingot S pulled out of the mold 40. Thus, an ingot S is continuously extruded while being solidified up to an inside of the ingot. "43" denotes a supplying pipe opened at the inlet side of the mold 40 to supply lubricating oil into the mold.

As a material of the molten metal pouring nozzle 70, a fire-resistant substance having a heat conductivity in the range of around 0.1 to 0.4 W/(m·° C.), such as, e.g., a fire-resistance substance containing a large amount of calcium silicate.

[Patent Document 1]

Japanese Unexamined Laid-open Patent Application Publication No. H11-170014

[Patent Document 2]

Japanese Unexamined Laid-open Patent Application Publication No. 2006-110558

DISCLOSURE OF THE INVENTION

Problems to be Solved by the Invention

When molding aluminum alloy containing 1 mass % or more of Mg using a horizontal continuous casting device having the aforementioned structure, there was a problem that the molten metal and the calcium silicate constituting the molten metal pouring nozzle 70 react, creating chemical compounds containing Ca, Mg, and O, and these reaction products adhere to the wall surface of the molten metal passage 71. If continuous casting is conducted in a state in which the reaction products are adhered to the molten metal passage 71, the temperature distribution of the molten metal M becomes uneven in the cross-section of the passage, deteriorating the ingot quality. Further, when the reaction products accumulate, they block the molten metal passage 71, which makes it impossible to continuously operate the device for a long period of time. Also, when the reaction products are detached from the wall surface due to the flow of the molten metal M and mixed in the molten metal M, the molten metal solidifies in a state in which it contains the reaction products, which significantly deteriorates the ingot quality.

Means for Solving the Problems

In view of the aforementioned technical background, the present invention aims to provide a molten metal pouring nozzle capable of preventing reaction with a molten metal and continuously casting a high-quality ingot for a long period of time, and a continuous casting device equipped with the molten metal pouring nozzle.

That is, the present invention has a structure as recited in the following Items [1] to [10].

[1] A molten metal pouring nozzle to be arranged between a molten metal receiving portion and a mold of a continuous casting device, the molten metal pouring nozzle comprising:

a main body portion having at least one molten metal passage and made of a fire-resistant substance; and a sleeve fitted in the molten metal passage of the main body portion, the sleeve being made of a material having a heat conductivity of 10 to 30 W/(m·° C.) which does not react with the molten metal.

[2] The molten metal pouring nozzle as recited in the aforementioned Item 1, wherein a thickness of the sleeve is 0.5 to 3 mm.

[3] The molten metal pouring nozzle as recited in the aforementioned Item 1 or 2, wherein the sleeve has a convex portion or a concave portion and the main body portion has a concave portion or a convex portion corresponding to the convex portion or the concave portion of the sleeve, and wherein the sleeve is fitted in the molten metal passage of the main body portion in a manner such that the sleeve is prevented from being pulled out of the molten metal passage of the main body portion by concave and convex engagement.

[4] The molten metal pouring nozzle as recited in the aforementioned Item 3, wherein the sleeve has an outwardly protruded flange portion at a molten metal inlet side end portion of the sleeve and the main body portion has a concave portion for fitting the flange portion at an inlet side end face of the molten metal passage of the main body portion.

[5] The molten metal pouring nozzle as recited in any one of the aforementioned Items 1 to 4, wherein the molten metal passage is formed at a position displaced from a center of the main body portion.

[6] The molten metal pouring nozzle as recited in any one of the aforementioned Items 1 to 5, wherein the main body portion has a plurality of molten metal passages.

[7] The molten metal pouring nozzle as recited in any one of the aforementioned Items 1 to 6, wherein a material of the sleeve is any one of silicon nitride, silicon carbide, boron nitride, and graphite.

[8] The molten metal pouring nozzle as recited in any one of the aforementioned Items 1 to 7, wherein a heat conductivity of a fire-resistance substance constituting the main body portion is 0.1 to 0.4 W/(m·° C.).

[9] A continuous casting device equipped with a molten metal receiving portion, a mold, and a molten metal pouring nozzle arranged between the molten metal receiving portion and the mold, wherein the molten metal pouring nozzle is equipped with a main body portion having at least one molten metal passage and made of a fire-resistance substance, and wherein a sleeve made of a material having a heat conductivity of 10 to 30 W/(m·° C.) which does not react with the molten metal is fitted in the molten metal passage of the main body portion.

[10] The continuous casting device as recited in the aforementioned Item 9, wherein the continuous casting device is a horizontal continuous casting device in which a central axis of a molding hole of the molten metal passage of the molten metal pouring nozzle and the mold is arranged approximately horizontally.

Effects of the Invention

In the molten metal pouring nozzle as recited in the aforementioned Item [1], the molten metal and the main body portion do not come into contact with each other since the molten metal passage of the main body portion is covered with the sleeve. Therefore, reaction products of the molten metal and fire-resistance substances constituting the main body portion will not be created, which does not cause unevenness of the temperature distribution of the molten metal due to the accumulation of the reaction products, and also does not disturb the molten metal flow. This in turn enables casting of a high quality ingot for a long period of time without causing deterioration of the quality of the ingot due to reaction products.

According to the molten metal pouring nozzle as recited in the aforementioned Item [2], the sleeve has a moderate strength. In addition, the molten metal will not be excessively heat-released, and therefore there is no danger of deteriorating the metal flow of the molten alloy due to the quick cooling of the molten metal.

According to the molten metal pouring nozzle as recited in the aforementioned Items [3] and [4], detachment of the sleeve from the molten metal passage can be prevented.

According to the molten metal pouring nozzle as recited in the aforementioned Items [5] and [6], the temperature distribution of the molten metal can be controlled.

In the molten metal pouring nozzle as recited in the aforementioned Item [7], silicon nitride, silicon carbide, boron nitride, and graphite are materials which each meets conditions for the sleeve.

According to the molten metal pouring nozzle as recited in the aforementioned Item [8], superior heat insulation can be secured.

The continuous casting device as recited in the aforementioned Item [9] is equipped with the molten metal pouring nozzle as recited in any one of the aforementioned Items [1] to [8], and therefore, reaction products will not be created at the molten metal pouring nozzle, which enables casting of a high-quality ingot for a long period of time.

In cases where the continuous casting device as recited in the aforementioned Item [10] is a horizontal continuous casting device, the molten metal is pressed to the lower surface side of the mold by gravity, which causes a tendency that the cooling starts quickly. This causes partial quick solidification start, disrupting the solidification balance of the mold, which results in an inhomogeneous solidification structure. As explained above, since there is a higher possibility for the disruption of the solidification balance in horizontal continuous casting than in vertical continuous casting, there is a great significance of applying the present invention capable of controlling the temperature distribution of the molten metal passing through the molten metal pouring nozzle by the fitted sleeve to a horizontal continuous casting.

BRIEF DESCRIPTION OF THE REFERENCE NUMERALS

Figure 1:
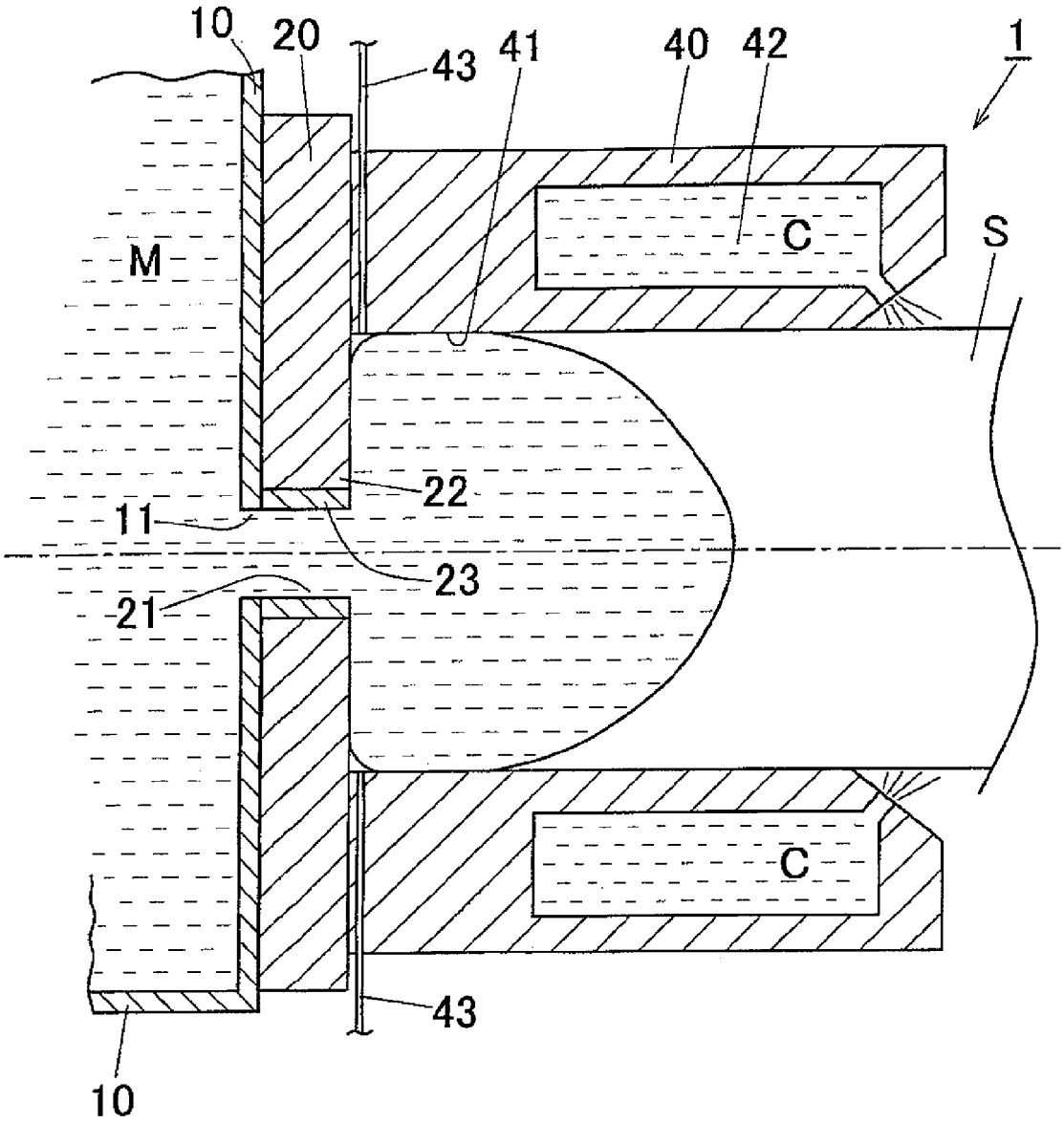
FIG. 1 is a schematic cross-sectional view showing an embodiment of a molten metal pouring nozzle according to the present invention and a horizontal continuous casting device equipped with the molten metal pouring nozzle.

1: horizontal continuous casting device (continuous casting device)
10: molten metal receiving portion
20, 30, 50, 55, 60, 65, 70: molten metal pouring nozzle
21, 31, 51, 56, 61, 66, 71: molten metal passage
22, 32, 52, 57, 62, 67: main body portion
23, 33, 53, 58, 63, 68: sleeve
40: mold
41: molding hole

BEST MODE FOR CARRYING OUT THE INVENTION

Figure 2:
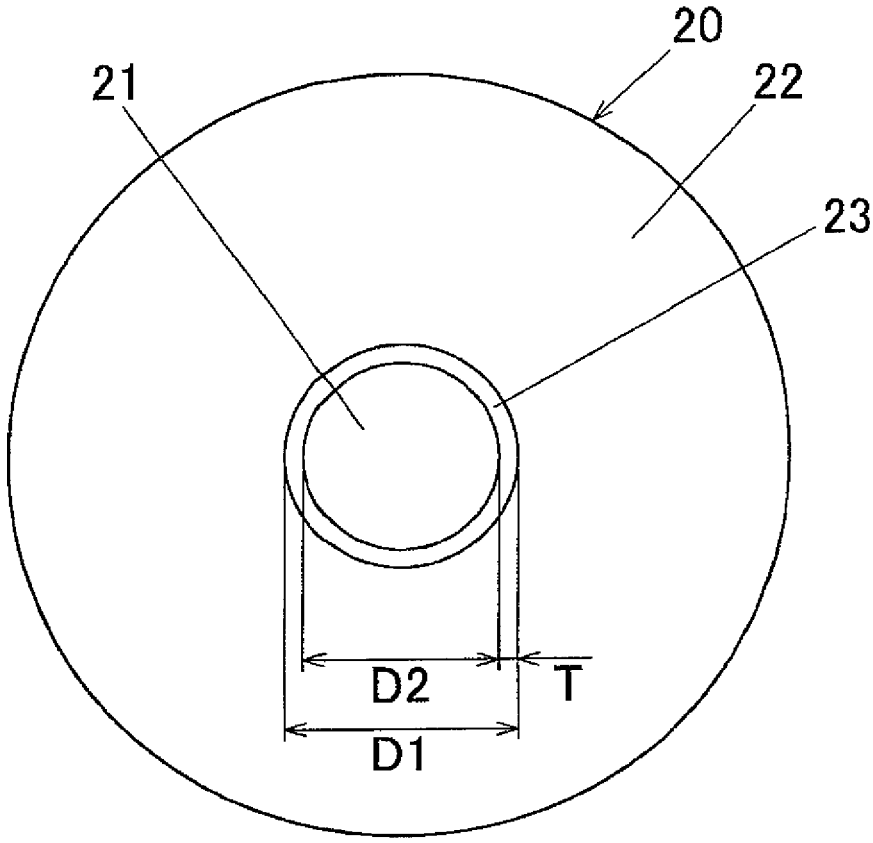
FIG. 2 is a view showing a mold-side end face of the molten metal pouring nozzle as seen from the molding hole of the mold.

The horizontal continuous casting device 1 shown in FIGS. 1 and 2 is an embodiment of a continuous casting device according to the present invention.

In the aforementioned horizontal continuous casting device 1, "10" denotes a molten metal receiving portion having a metal outlet portion 11 at the side wall, "20" denotes a molten metal pouring nozzle having a molten metal passage 21 round in cross-section, and "40" is a mold having a molding hole 41 round in cross-section. In these members 10, 20, and 40, the molten metal outlet portion 11, the molten metal passage 21 and the molding hole 41 are communicated with each other, and the central axis of the communicated holes are arranged approximately horizontally. The molten metal M in the molten metal receiving portion 10 is introduced into the molding hole 41 of the mold 40 via the molten metal passage 21 of the molten metal pouring nozzle 20 and cooled to be solidified. The solidified ingot S is continuously pulled out of the mold 40 with a pulling device (not illustrated). The pulling rate becomes equal to a casting rate, and the rate can be set to, for example, 300 to 1,500 mm/min.

The mold 40 has a cavity 42 therein and is configured to flow cooling water C supplied from a supplying pipe (not illustrated) through the cavity 42 to cool the mold 40 to thereby perform primary cooling of the ingot S in the molding hole 41 and spray the cooling water C through the opening formed at the outlet side toward the ingot S casted from the outlet to perform secondary cooling of the ingot S. At the inlet side of the molding hole 41, a lubricating oil supplying pipe 43 opened to the molding hole 41 is provided.

FIG. 2 shows a molten metal pouring nozzle 20 as seen from the side of the molding hole 41 of the mold 40, and shows an end face of the molten metal pouring nozzle 20 facing the molding hole 41. The molten metal pouring nozzle 20 has, at the central portion of the main body portion 22 made of fire-resistance substance, a circular molten metal passage 21 with a diameter D1, and a cylindrical sleeve 23 made of silicon nitride higher in heat conductivity than the main body portion 22 is fitted in the molten metal passage 21 of the main body portion 22. The outer diameter of the sleeve 23 corresponds to the diameter D1 of the molten metal passage 21, and the sleeve 23 is mounted in the molten metal passage 21 in such a way as to be fitted on the wall surface of the passage. With this structure, the molten metal passage 21 is covered with the sleeve 23 without the main body being exposed. The inner diameter of the sleeve 23 is D2, and the round space having the diameter D2 in cross-section defines a substantial molten metal passage.

The fire-resistant substance constituting the aforementioned main body portion 22 is not specifically limited, but it is preferable to use a material excellent in heat insulating property with a heat conductivity in the range of 0.1 to 0.4 W/(m·° C.). If the heat conductivity is below 0.1 W/(m·° C.), it is difficult to obtain a material having a compression strain as a structural material. If the heat conductivity exceeds 0.4 W/(m ° C.), the heat insulating property becomes insufficient. It is more preferable to use a material with a heat conductivity in the range of 0.12 to 0.17 W/(m·° C.). As a materials having a heat conductivity in the aforementioned range, calcium silicate and a mixture of silica and alumina can be exemplified. In particular, it is preferable that the heat conductivity of the material constituting the sleeve 23 is 25 to 300 times, or more preferably 59 to 250 times, the heat conductivity of the fire-resistant substance constituting the main body portion 22 surrounding the vicinity of the sleeve material 23 because of the following reasons. By selecting materials so that the ratio of the heat conductivities of both materials falls within the aforementioned range, the heat from the molten metal M can be kept in the sleeve 23 without releasing it to the main body portion 22, and the temperature can be equalized by the heat transfer in the sleeve 23, equalizing the temperature in the molten metal passage 21.

On the other hand, the sleeve 23 is a portion which directly comes into contact with the molten metal M, and therefore required to be constituted by a material which does not react with the molten metal M. A material which does not react with the molten metal M is generally excellent in heat conductivity and high in heat releasing property. However, since the heat insulating property required for a nozzle is secured by the main body portion 22, low heat conductivity such as in the main body portion 22 is not required. For this reason, as the material of the sleeve 23, a material having a heat conductivity in the range of 10 to 30 W/(m·° C.) which does not react with a molten metal is used. If the heat conductivity is below 10 W/(m·° C.), the porosity becomes high, which is not suitable for a repeated use thereof. If it exceeds 30 W/(m·° C.), materials high-reactivity with a molten metal increases. The more preferable heat conductivity is 16 to 26 W/(m·° C.). As a material which has a heat conductivity falling within the aforementioned range and is non-reactive with a molten metal, it is recommended to use silicon nitride, silicon carbide, boron nitride, or graphite.

The thickness T of the sleeve preferably falls within the range of 0.5 to 3 mm. If the thickness T is less than 0.5 mm, strength is insufficient, resulting in high risk of breakage, and sufficient reaction preventing effects cannot be obtained. On the other hand, if it exceeds 3 mm, heat will be released at the time of starting the casting, which may cause deterioration of fluidity of the molten metal M in the flow passage. The preferable thickness T of the sleeve 23 falls in the range of 1 to 2 mm.

The molten metal pouring nozzle 20 does not create a reaction product since the molten metal M and the sleeve 23 which directly comes into contact with the molten metal M does not react with each other. Furthermore, the heat insulating property as the flow passage of the molten metal M has been secured by the main body portion 22, which does not cause deteriorated fluidity of the molten metal m due to quick cooling of the molten metal M. Therefore, there is no concern that reaction products adhere to the flow passage of the molten metal M to cause uneven molten metal temperatures in the flow passage cross-section and that the detached reaction products are mixed into the molten metal M to be involved in an ingot S. Thus, a high-quality ingot can be continuously casted. Furthermore, reaction products never accumulate to block the flow passage, enabling long hours of continuous operation. Because of these reasons, a high quality ingot can be produced efficiently.

Furthermore, the molten metal M and the main body portion 22 are not brought into direct contact with each other, causing no damage or no abrasion of the main body portion 22. This enables repeated use of the main body portion 22 by replacing the sleeves 23.

In the sleeve 23 shown in FIG. 1, the sleeve 23 is prevented from being pulled out of the main body portion 22 by making the clearance between the sleeve 23 and the molten metal passage 21 of the main body portion 22 as smaller as possible. In place of the above, the pulling-out can be assuredly prevented by utilizing a concavo-convex fitting as explained below.

Figure 3:
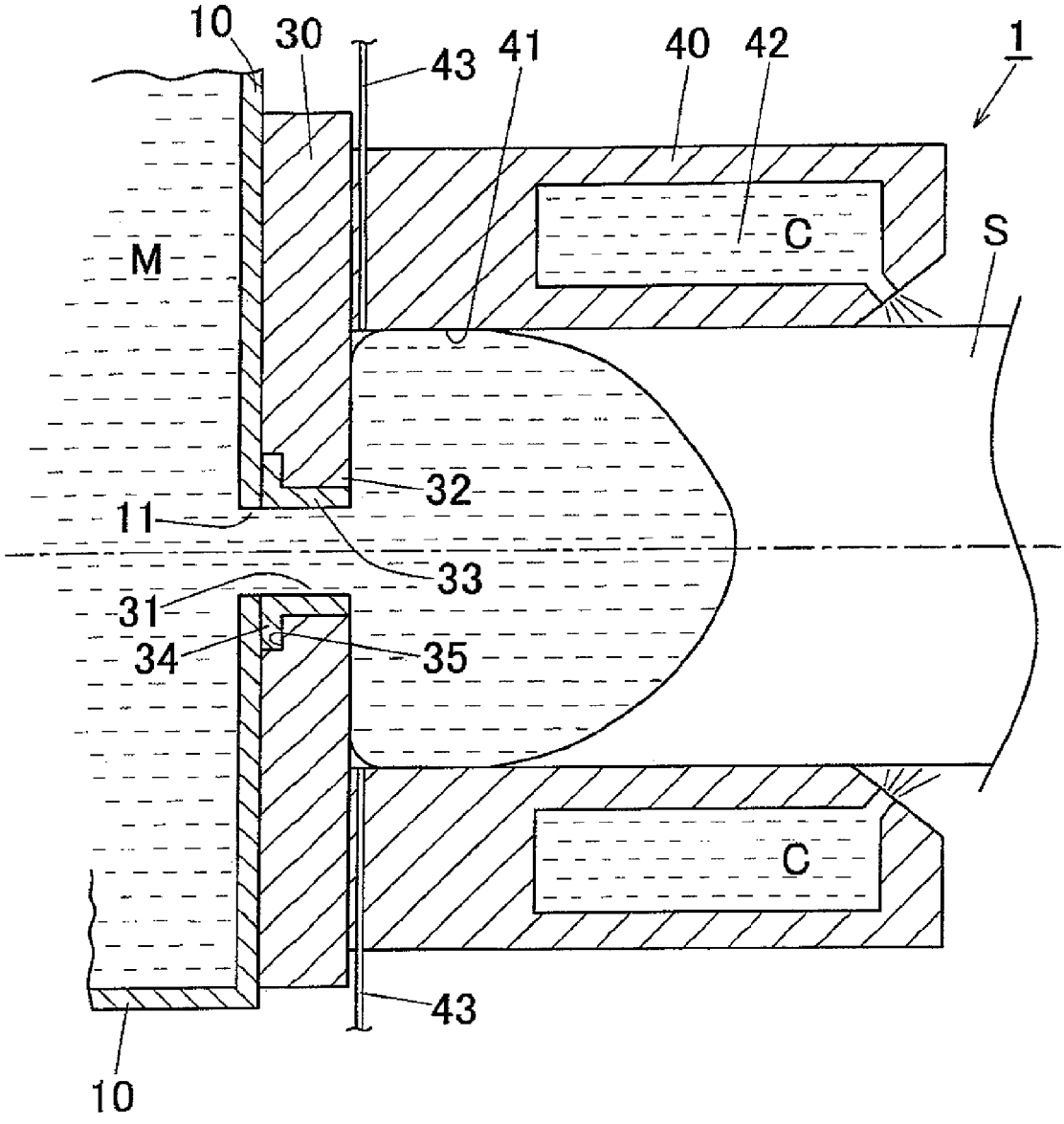
FIG. 3 is a schematic cross-sectional view showing another molten metal pouring nozzle and a horizontal continuous casting device equipped with the molten metal pouring nozzle.
Figure 4A:
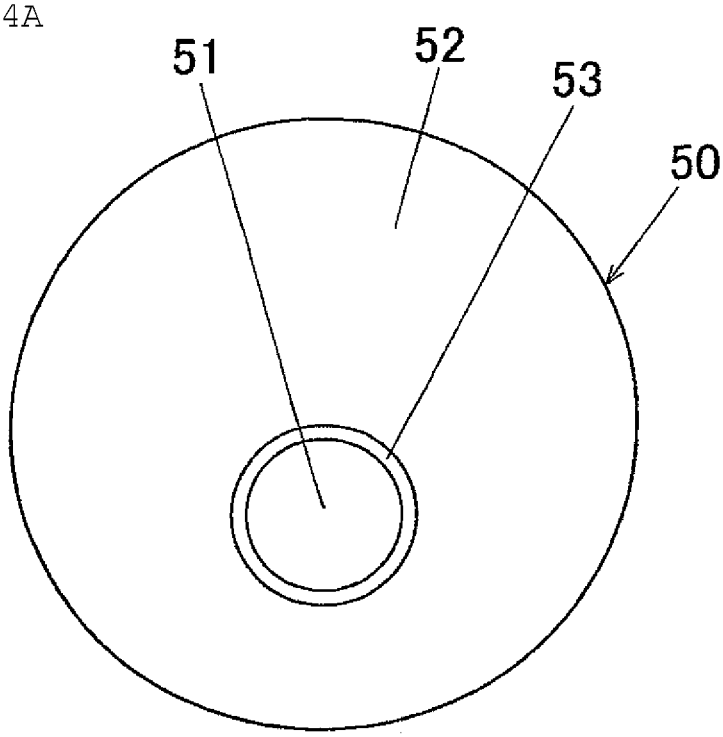
FIG. 4A is a view showing a mold-side end face of still another molten metal pouring nozzle as seen from the molding hole of the mold.
Figure 4B:
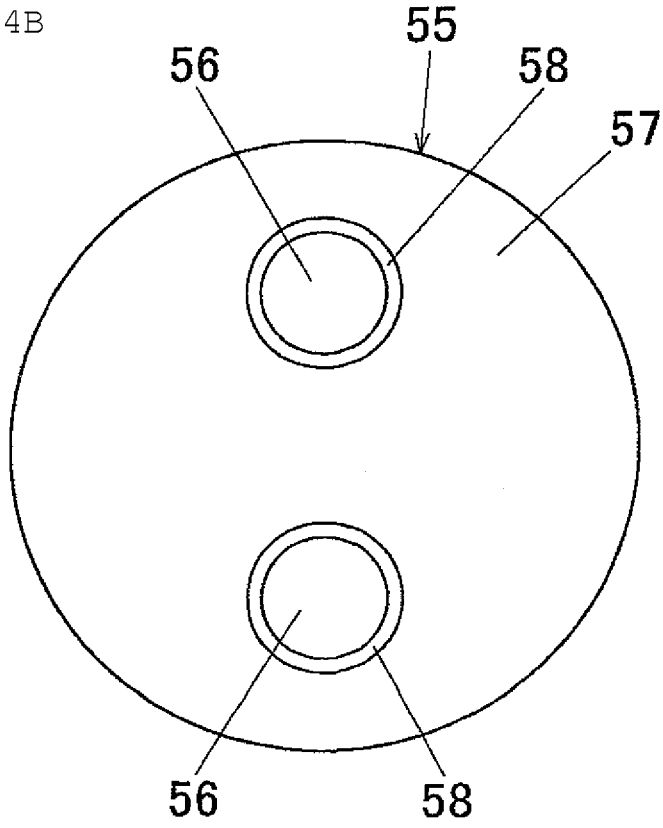
FIG. 4B is a view showing a mold-side end face of still yet another molten metal pouring nozzle as seen from the molding hole of the mold.
Figure 4C:
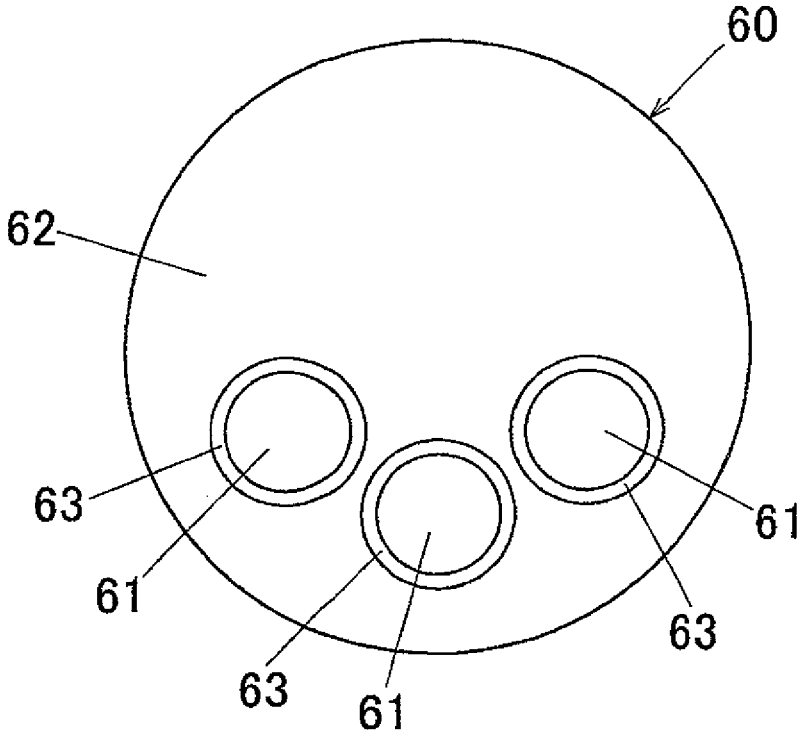
FIG. 4C is a view showing a mold-side end face of still further yet another molten metal pouring nozzle as seen from the molding hole of the mold.
Figure 4D:
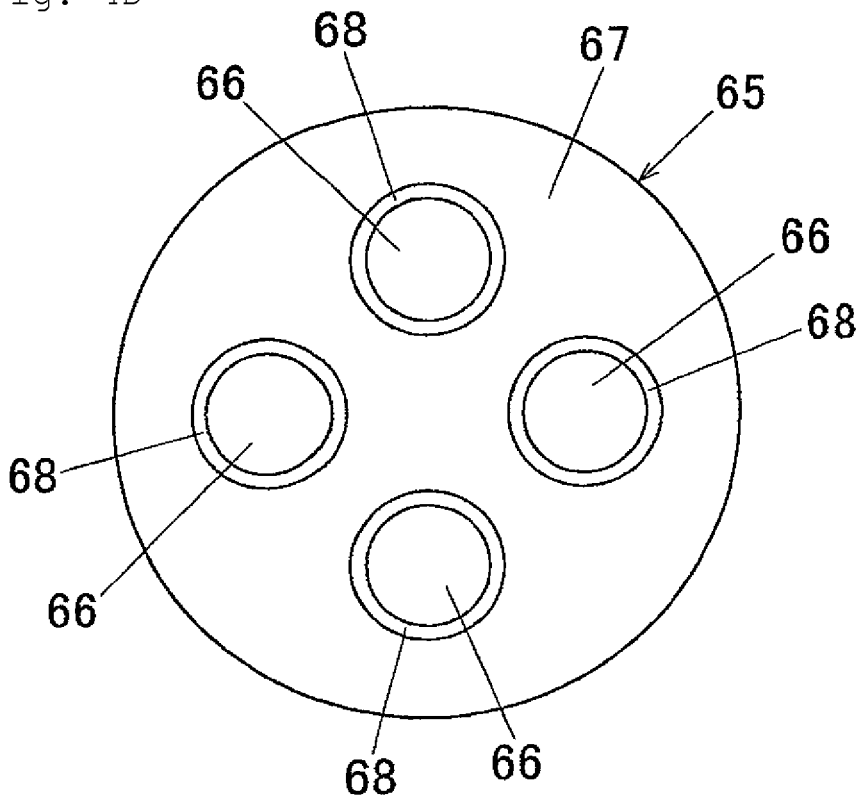
FIG. 4D is a view showing a mold-side end face of still further yet another molten metal pouring nozzle as seen from the molding hole of the mold.

In the molten metal pouring nozzle 30 shown in FIG. 3, the sleeve 33 is generally cylindrical in shape, and the outer diameter is set to a size corresponding to the diameter D1 of the molten metal passage 31 of the main body portion 32. Furthermore, at the molten metal inlet side periphery of the cylindrical portion, a flange portion 34 protruded outwardly is formed. On the other hand, at the molten metal inlet side end face of the molten metal passage 31 of the main body portion 32, a dented stepped portion 35 corresponding to the thickness of the flange portion 34 is formed. When the sleeve 33 is inserted from the inlet side of the molten metal pouring passage 31 of the main body portion 32, the flange portion 34 of the sleeve 33 is engaged with the stepped portion 35 of the main body portion 32. As a result, the inlet side end face of the molten metal pouring nozzle 30 forms a continuous single flat surface of two members. In the molten metal pouring nozzle 30 having the aforementioned fitting structure, the molten metal M always flows toward the mold 40, causing the flange portion 34 to be pressed against the stepped portion 35. Thus, the sleeve 35 becomes in a pulling-out prevented state.

The fitting structure of the molten metal pouring sleeve and the main body portion is not limited to the illustrated embodiment. It can be configured such that a sleeve has a dented portion and a main body portion has a protruded portion. However, since forming a dented portion on a thin sleeve causes deterioration of the strength, it is preferable that a dented portion is formed on a thick main body portion and a protruded portion is formed on a sleeve. Forming a protruded portion on a sleeve increases the strength of the sleeve.

In the molten metal pouring sleeve of the present invention, the number and/or position of the molten metal passage is not limited. Although the molten metal pouring sleeve 20 and 30 shown in FIGS. 1 to 3 has a single molten metal pouring passage 21 and 31 in the center portion thereof, it can be configured such that a molten metal pouring passage can be formed at a position displaced from the center and/or that a plurality of molten metal pouring passages can be formed.

FIGS. 4A to 4D each shows an end face of a molten metal pouring nozzle as seen from the side of the molding hole of the mold 40. In the molten metal pouring nozzle 50 shown in FIG. 4A, a single molten metal passage 51 is formed at a position radially outwardly displaced from the center of the main body portion 52, and a sleeve 53 is fitted in the molten metal passage 51. In the molten metal pouring nozzle 55 shown in FIG. 4B, two molten metal passages 56 are formed above and below the center of the main body portion 57, and a sleeve 58 is fitted in each of the molten metal passages 56. In the molten metal pouring nozzle 60 shown in FIG. 4C, three molten metal passages 61 are formed at lower portions of the main body portion 62, and a sleeve 63 is fitted in each of the molten metal passages 61. In the molten metal pouring nozzle 65 shown in FIG. 4D, four molten metal passages 66 are formed at right and left and upper and lower portions of the center of the main body portion 67, and a sleeve 68 is fitted in each of the molten metal passages 66.

As explained above, the sleeve is made of a material having a heat conductivity higher than the main body portion. This enables adjustment of the heat releasing amount from the sleeve by setting the number and/or position of the molten metal passages, which in turn can adjust the temperature distribution of the molten metal flowed into the mold to adjust the solidification balance in the mold.

Figure 5:
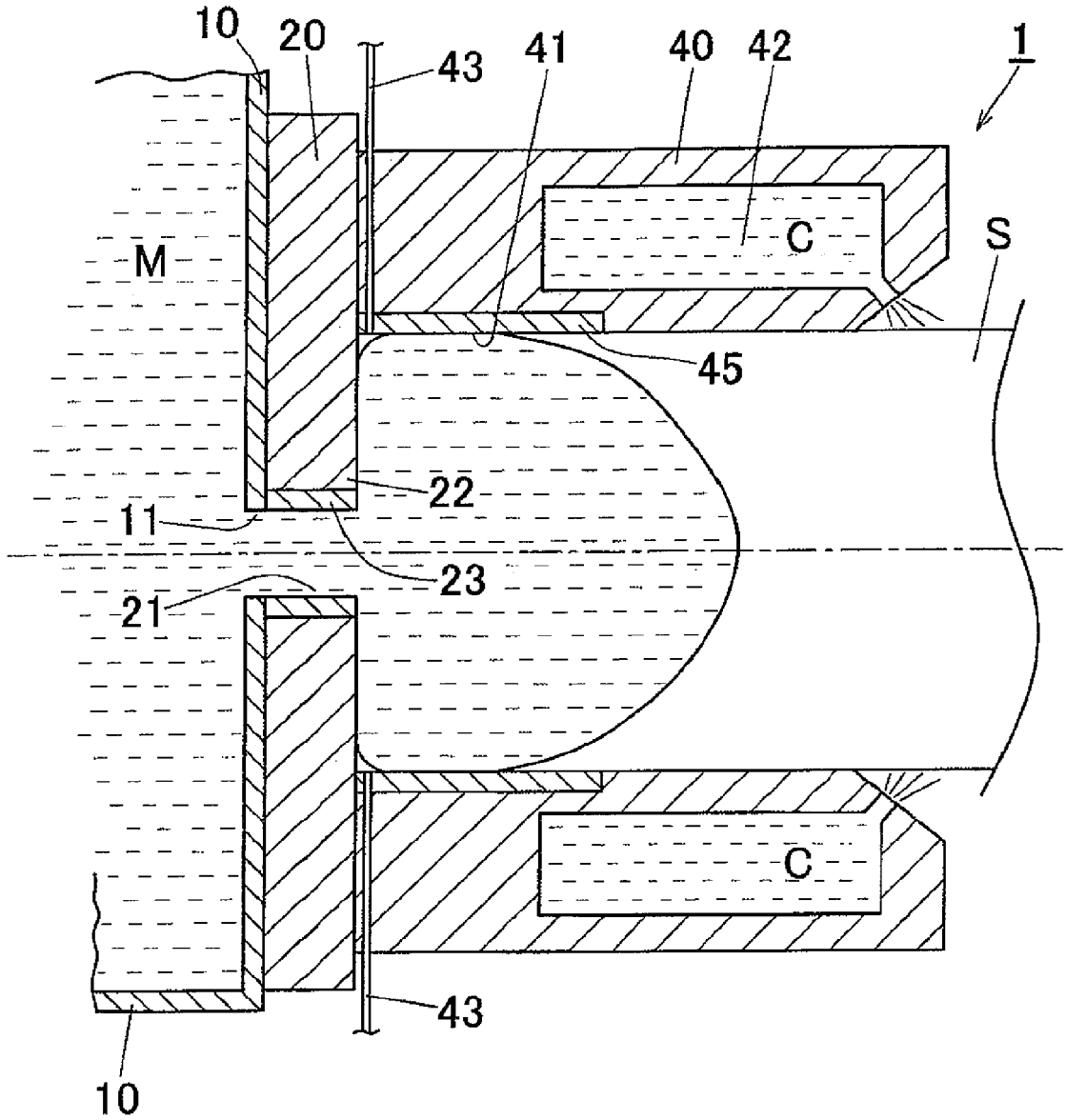
FIG. 5 is a schematic cross-sectional view of another embodiment of a continuous casting device according to the present invention.

Furthermore, in a continuous casting device equipped with a molten metal pouring nozzle of the present invention, the structure other than the molten metal pouring sleeve is not specifically limited. For example, in the horizontal continuous casting device shown in FIG. 5, a sleeve 45 made of a material high in self-lubricating property, such as, e.g., graphite, is mounted on a peripheral wall of the molding hole 41 of the mold 40 to enhance the sliding of the ingot.

The continuous casting device of the present invention is not limited to the illustrated horizontal continuous casting device in which the central axis of the molten metal passage of the molten metal pouring nozzle and the molding hole of the mold is arranged approximately horizontally so that the ingot advances generally horizontally, and can be applied to another casting device such as a vertical continuous casting device. However, because of the following reasons, the effects of the present invention are notable in a horizontal continuous casting device.

In a horizontal continuous casting device, it is considered that the ingot are pressed toward the lower surface side of the mold by gravity, enhancing the cooling of the lower surface side of the ingot, which quickens the solidification start of the lower surface side thereof. When the solidification starts quickens partially, the solidification balance of the mold is disrupted, causing uneven solidification structure. As explained above, in a horizontal continuous casting device, the possibility of disruption in solidification balance is higher than in a vertical continuous casting device, and therefore it is large in significance of applying the continuous casting device of the present invention in which the temperature distribution of the molten metal passing through the molten metal pouring nozzle can be adjusted by the fitting of the sleeve.

The molten metal pouring nozzle of the present invention can be applied to casting of any metal. For example, it can be applied to a continuous casting of aluminum or aluminum alloy. Especially in cases where it is applied to continuous casting of easy-to-adhere metal, remarkable effects can be exerted. As such easy-to-adhere metal, Al alloy containing Mg can be exemplified.

EXAMPLES

Figure 6:
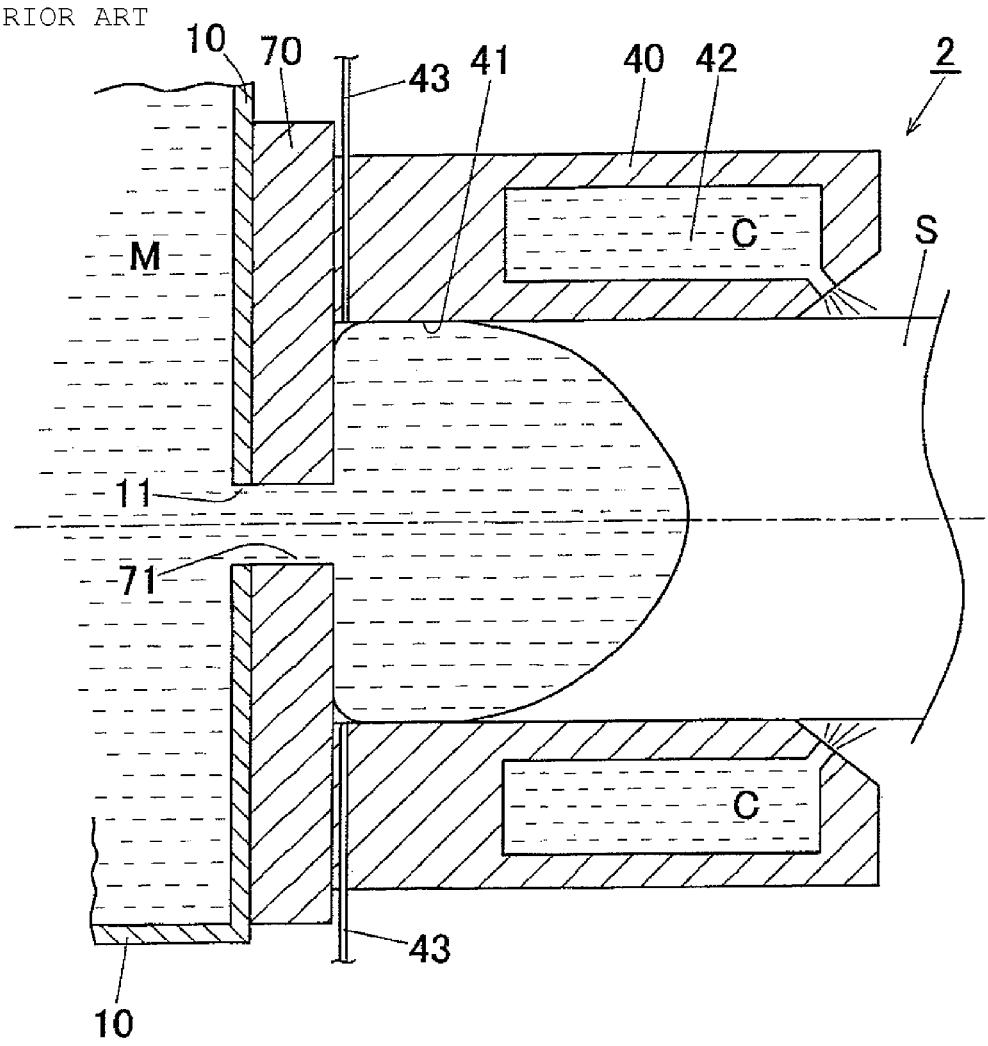
Fig. 6 PRIOR ART
FIG. 6 is a schematic cross-sectional view showing a conventional horizontal continuous casting device.

In the horizontal continuous casting device 1 shown in FIGS. 1 and 2 and a conventional horizontal continuous casting device 2 shown in FIG. 6, continuous casting tests of JIS 5056 aluminum alloy were performed while changing conditions of a molten metal pouring nozzle 20 and 70 disposed between the molten metal receiving portion 10 and the mold 40.

In the molten metal pouring nozzles 20 of Examples 1 to 4 shown in Table 1, a cylindrical sleeve 23 was fitted in a molten metal passage 21 round in cross-section of the main body portion 22. As the material of the main body portion 22, a calcium silicate plate having a heat conductivity of 0.138 W/(m·° C.) (made by NICHIAS Corporation, Product Name: Lumi Board) was used. As the material of the sleeve 23, a silicon nitride having a heat conductivity of 16.7 W/(m·° C.) was used. Four types of sleeves 23 having a thickness of 0.5 mm, 1.0 mm, 2.0 mm, 3.0 mm were prepared. The inner diameter of each sleeve 23 was 15 mm. By changing the outer diameter, each sleeve had the same thickness T. On the other hand, a molten metal passage 21 having a diameter corresponding to the outer diameter of each sleeve 23 was formed in the main body portion 22, and the sleeve 23 was fitted in the molten metal passage 21.

On the other hand, in the molten metal pouring nozzle 70 of Comparative Example, a molten metal passage 71 having a diameter of 15 mm was formed in the aforementioned calcium silicate plate.

In each of Examples and Comparative Example, the diameter of the molding hole of the mold 40 was 40 mm.

Using the horizontal continuous casting devices 1 and 2 equipped with the aforementioned molten metal pouring nozzle 20 and 70, continuous casting was performed under the conditions of: casting temperature: 700° C.±10° C.: and casting rate: 600 mm/min, and continued until a smooth continuous casting became impossible.

The quality was evaluated by performing the appearance check of the ingot S produced by continuous casting and examining inclusion with FPMA. The inner side of the molten metal pouring nozzle 20 and 70 after the casting was observed to check whether or not any reaction product exists and investigate the state of the sleeve 23 or the main body portion 71. As a result, in the sleeve 23 of each Example, there was no evidence of reaction with the molten metal M and no reaction product was found. On the other hand, there was an evidence of reaction with the molten metal M on the wall surface of the molten metal passage 71 of Comparative Example, and it was confirmed that a reaction product was accumulated. The continuous operation in Comparative Example was disturbed by the reaction products accumulated on the molten metal passage 71.

Furthermore, based on the continuous casting time, reaction product, and ingot quality, comprehensive evaluation was performed by the two-grade evaluation of ○: excellent and X: poor Table 1 shows the structure of the molten metal pouring nozzle, and the evaluation results are shown in Table 1.

TABLE 1

| | | Evaluation | | | |
|---|---|---|---|---|---|
| | Sleeve thickness T: mm | Continuous casting time | Reaction product | Ingot quality | Comprehensive evaluation |
| Example 1 | 0.5 | 8 hours or more | No | No inclusion | ○ |
| Example 2 | 1.0 | 8 hours or more | No | No inclusion | ○ |

TABLE 1-continued

| | Sleeve thickness T: mm | Evaluation | | | |
|---|---|---|---|---|---|
| | | Continuous casting time | Reaction product | Ingot quality | Comprehensive evaluation |
| Example 3 | 2.0 | 8 hours or more | No | No inclusion | ○ |
| Example 4 | 3.0 | 8 hours or more | No | No inclusion | ○ |
| Comparative Example | No sleeve | 6 hours | Yes | MgO was detected | X |

From Table 1, it was confirmed that a high quality ingot can be casted effectively without creating reaction products with a molten metal by fitting the sleeve to the molten metal passage of the molten metal pouring nozzle.

This application claims priority to Japanese Patent Application No. 2007-326371 filed on Dec. 18, 2007, the entire disclosure of which is incorporated herein by reference in its entirety.

It should be understood that the terms and expressions used herein are used for explanation and have no intention to be used to construe in a limited manner, do not eliminate any equivalents of features shown and mentioned herein, and allow various modifications falling within the claimed scope of the present invention.

INDUSTRIAL APPLICABILITY

In the molten metal pouring nozzle, a sleeve which does not react with a molten metal is fitted in a molten metal passage of a main body portion, and therefore the molten metal and the main body portion do not come into contact with each other, generating no reaction product thereof. Thus, no continuous operation is disturbed by accumulation of reaction products, and therefore the nozzle can be used for stable casting.

The invention claimed is:

1. A molten metal pouring nozzle comprising:

a main body portion including at least one molten metal passage and made of a fire-resistant substance; and a sleeve fitted in the at least one molten metal passage of the main body portion, the sleeve being made of a material having a heat conductivity of 10 to 30 W/(m·° C.) which does not react with the molten metal; wherein the sleeve includes an outwardly protruding flange portion including a molten metal inlet axial end surface of the sleeve;

the main body portion includes a stepped portion arranged to accommodate the flange portion of the sleeve therein at an inlet side end surface of the at least one molten metal passage of the main body portion;

the sleeve is fitted in the at least one molten metal passage of the main body portion such that the sleeve is prevented from being pulled out of the at least one molten metal passage of the main body portion due to the flange portion of the sleeve being accommodated in the stepped portion of the main body portion;

the molten metal pouring nozzle is arranged such that the molten metal inlet axial end surface of the sleeve is not in contact with the molten metal in a metal receiving portion; and a material of the sleeve is any one of silicon nitride, silicon carbide, boron nitride, and graphite.

2. The molten metal pouring nozzle as recited in claim 1, wherein a thickness of the sleeve is 0.5 to 3 mm.

3. The molten metal pouring nozzle as recited in claim 1, wherein the molten metal passage is disposed at a position displaced from a center of the main body portion.

4. The molten metal pouring nozzle as recited in claim 1, wherein the main body portion includes a plurality of molten metal passages.

5. A molten metal pouring nozzle comprising:

a main body portion including at least one molten metal passage and made of a fire-resistant substance; and a sleeve fitted in the at least one molten metal passage of the main body portion, the sleeve being made of a material having a heat conductivity of 10 to 30 W/(m·° C.) which does not react with the molten metal; wherein the sleeve includes an outwardly protruding flange portion including a molten metal inlet axial end surface of the sleeve;

the main body portion includes a stepped portion arranged to accommodate the flange portion of the sleeve therein at an inlet side end surface of the at least one molten metal passage of the main body portion;

the sleeve is fitted in the at least one molten metal passage of the main body portion such that the sleeve is prevented from being pulled out of the at least one molten metal passage of the main body portion due to the flange portion of the sleeve being accommodated in the stepped portion of the main body portion;

the molten metal pouring nozzle is arranged such that the molten metal inlet axial end surface of the sleeve is not in contact with the molten metal in a metal receiving portion; and a heat conductivity of a fire-resistance substance constituting the main body portion is 0.1 to 0.4 W/(m·° C.).

6. The molten metal pouring nozzle as recited in any claim 5, wherein a material of the sleeve is any one of silicon nitride, silicon carbide, boron nitride, and graphite.

7. The molten metal pouring nozzle as recited in claim 5, wherein a thickness of the sleeve is 0.5 to 3 mm.

8. The molten metal pouring nozzle as recited in claim 5, wherein the molten metal passage is disposed at a position displaced from a center of the main body portion.

9. The molten metal pouring nozzle as recited in claim 5, wherein the main body portion includes a plurality of molten metal passages.

10. A continuous casting device including a molten metal receiving portion, a mold, and a molten metal pouring nozzle; wherein the molten metal pouring nozzle includes a main body portion including at least one molten metal passage and made of a fire-resistance substance;

a sleeve made of a material having a heat conductivity of 10 to 30 W/(m·° C.) which does not react with the molten metal is fitted in the at least one molten metal passage of the main body portion;

the sleeve includes an outwardly protruding flange portion including a molten metal inlet axial end surface of the sleeve;

the main body portion includes a stepped portion arranged to accommodate the flange portion of the sleeve therein at an inlet side end surface of the at least one molten metal passage of the main body portion;

the sleeve is fitted in the at least one molten metal passage of the main body portion such that the sleeve is prevented from being pulled out of the at least one molten metal passage of the main body portion due to the flange portion of the sleeve being accommodated in the stepped portion of the main body portion;

the molten metal receiving portion includes at least one side wall including a molten metal outlet portion in communication with the at least one molten metal passage;

the at least one side wall of the molten metal receiving portion covers the molten metal inlet axial end surface of the sleeve such that the molten metal inlet axial end surface of the sleeve is not in contact with the molten metal in the molten metal receiving portion; and the continuous casting device is a horizontal continuous casting device in which a central axis of a molding hole of the molten metal passage of the molten metal pouring nozzle and the mold is arranged approximately horizontally.

11. The continuous casting device as recited in claim 10, wherein the molten metal inlet axial end surface of the sleeve and the main body portion define a continuous single flat surface.

12. The continuous casting device as recited in claim 10, wherein the molten metal pouring nozzle is arranged between the molten metal receiving portion and the mold.

* * * * *